US006273095B1

(12) United States Patent
Hsu

(10) Patent No.: US 6,273,095 B1
(45) Date of Patent: Aug. 14, 2001

(54) CIGARETTE FILTER WHICH REMOVES CARCINOGENS AND TOXIC CHEMICALS

(76) Inventor: Jong-Pyng Hsu, 9210 Chaddsford, San Antonio, TX (US) 78250

( * ) Notice: Subject to any disclaimer, the term of this patent is extended or adjusted under 35 U.S.C. 154(b) by 0 days.

(21) Appl. No.: 09/252,334

(22) Filed: Feb. 18, 1999

Related U.S. Application Data

(60) Provisional application No. 60/093,330, filed on Jul. 20, 1998.

(51) Int. Cl.[7] ..... A24B 15/28

(52) U.S. Cl. ..... 131/332; 131/340; 131/339; 131/341; 131/344; 131/345; 55/318; 55/387; 493/39

(58) Field of Search ..... 131/339, 340, 131/341, 344, 345, 332; 55/318, 387

(56) References Cited

U.S. PATENT DOCUMENTS

| | | | |
|---|---|---|---|
| 3,006,346 | 10/1961 | Golding . | |
| 3,332,427 | 7/1967 | Garzia . | |
| 3,347,245 | 10/1967 | Hawkins . | |
| 3,618,618 | 11/1971 | Strickman . | |
| 3,662,765 * | 5/1972 | Clark | 131/265 |
| 3,746,014 | 7/1973 | Salyer et al. . | |
| 3,828,801 | 8/1974 | Merrill . | |
| 3,925,248 * | 12/1975 | Moroni et al. | 252/428 |
| 4,250,901 | 2/1981 | Yamaguchi . | |
| 4,517,995 | 5/1985 | Lyles . | |
| 5,076,295 | 12/1991 | Saintsing . | |
| 5,083,578 | 1/1992 | Agarie et al. . | |

FOREIGN PATENT DOCUMENTS

| | | |
|---|---|---|
| 1023918 | 3/1966 | (GB) . |
| 63-209718 | 2/1987 | (JP) . |
| 1-317538 | 6/1988 | (JP) . |
| WO 87/00734 | 2/1987 | (WO) . |

* cited by examiner

*Primary Examiner*—Stanley S. Silverman
*Assistant Examiner*—M. Halpern
(74) *Attorney, Agent, or Firm*—Knobbe, Martens, Olson & Bear, LLP

(57) ABSTRACT

Disclosed herein is a filter for use with tobacco products, such as cigarettes, cigars and pipes, which selectively absorbs toxic compounds and carcinogenic polynuclear aromatic compounds passing through it, but which permits most low molecular weight species, and in particular nicotine, to pass through. The filter is made from a middle-density polyurethane foam which is pre-treated to increase the number of binding sites for polynuclear aromatic compounds.

15 Claims, 1 Drawing Sheet

CIGARETTE FILTER WHICH REMOVES CARCINOGENS AND TOXIC CHEMICALS

CROSS-REFERENCE TO RELATED APPLICATION

The present application claims priority under 35 U.S.C. § 119(e) to U. S. Provisional Application Serial No. 60/093,330, entitled SAFE CIGARETTE FILTER, filed Jul. 20, 1998, the entirety of which is incorporated herein by reference.

FIELD OF THE INVENTION

The present invention generally relates to filters for use with tobacco products. In particular, the present invention relates to a filter which selectively removes toxic and carcinogenic compounds from tobacco smoke passing through it, but permits most of the lower molecular weight species, such as nicotine, to pass through.

BACKGROUND OF THE INVENTION

People begin smoking cigarettes for a variety of reasons. Smoking has been portrayed as being heroic, cool and as enhancing sexual appeal. For some people, smoking also serves to soothe tension, anxiety, or loneliness. However, as is commonly known, cigarette smoke contains the addictive compound nicotine. Addiction to nicotine makes it very difficult for smokers to stop smoking cigarettes, even though many realize that smoking will adversely affect their health.

The serious negative health effects of smoking are generally caused by chemicals in tobacco smoke other than nicotine. Among these are polynuclear aromatic compounds, which are carcinogens suspected to cause or contribute to a variety of cancers. The formation of polynuclear aromatic compounds in cigarette smoke is the result of incomplete combustion of the cigarette due to short burning resident time. Furthermore, polynuclear aromatic compounds harm not only smokers, but also the surrounding environment and people who inhale them as second-hand smoke. Furthermore, tobacco smoke also contains cyanide, a highly toxic compound which causes adverse health effects in smokers and those inhaling second-hand smoke.

The tobacco industry has attempted to alleviate the problems caused by polynuclear aromatics and cyanide by incorporating filters into cigarettes to remove these compounds when a smoker inhales. These filters are typically made of cellulose-based materials. The filters are effective in removing some of the toxic chemicals from tobacco smoke, but a substantial amount still passes through the filter. Consequently, there exists a need for improved filters for cigarettes and other tobacco products which are more efficacious in removing toxic and carcinogenic chemicals from tobacco smoke. Moreover, to encourage use of such a filter, the filter should not interfere with those aspects of smoking which smokers desire, including the taste and nicotine content of the smoke.

SUMMARY OF THE INVENTION

The present invention advantageously provides a filter which selectively removes polynuclear aromatic compounds and cyanide from tobacco smoke, while permitting most of the nicotine and flavor-enhancing molecules in the smoke to pass through. Because of this, people smoking tobacco products who use the filter of the present invention may enjoy the smoking experience, but with less exposure to the dangerous components of tobacco smoke.

In one aspect of the present invention, there is provided a polyurethane foam filter for removing polynuclear aromatic compounds and cyanide from cigarette smoke. The polyurethane foam filter comprises a tubular body with a proximal and distal end. The tubular body is formed out of middle-density cellular polyurethane foam. The foam is pre-treated to increase the number of available binding sites for absorbing polynuclear aromatics and cyanide. When used with a cigarette having a conventional filter, the polyurethane foam filter having an uncompressed volume of about 2 cubic centimeters absorbs about 60% of the polynuclear aromatic compounds and cyanide contained in cigarette smoke which contact the filter, but permits about 75% of the contacting nicotine in the smoke to pass through.

In another embodiment, a polyurethane foam filter of the present invention is substantially substituted for a conventional cigarette filter and is incorporated into the body of the cigarette as part of the manufacturing process. In this embodiment, a polyurethane foam filter, which prior to incorporation into the cigarette has an uncompressed volume of about 2-cubic centimeters, absorbs at least 74% of the polynuclear aromatic hydrocarbons contacting the filter in the cigarette, but permits about 75% of the nicotine contacting the filter to pass through. In another embodiment, a similarly sized polyurethane foam filter of the present invention is completely substituted for a conventional cigarette filter and absorbs at least 90% of the polynuclear aromatic hydrocarbons which pass through the filter.

In another aspect of the present invention, there is provided an improved filter for removing carcinogenic and toxic compounds from tobacco smoke. The invention comprises a pre-treated polyurethane foam body which absorbs 30–45% of contacting total polynuclear aromatic compounds per cubic centimeter of uncompressed polyurethane foam material forming the filter, but which permits more than 30% of the contacting nicotine to pass through unabsorbed per cubic centimeter of polyurethane foam material. The improved filter having these properties may be incorporated into a cigarette body, a cigar or a pipe body.

In another aspect of the present invention, there is provided a pre-treated polyurethane foam filter which absorbs in aggregate 60%–90% of 2-methylnaphthalene, acenaphthylene, acenaphthene, dibenzofuran, fluorene, phenanthrene, anthracene, carbazole, fluoranthene, pyrene, benzo(a)anthracene and chrysene in tobacco smoke passing through the filter per 2 cubic centimeters of uncompressed foam used to make the filter.

In another aspect of the present invention, there is provided a method of making a safer cigarette. The method comprises providing a middle-density cellular polyurethane foam (PUF), which may then be formed into a cylindrical body to form a filter. The PUF filter is then pre-treated by cleaning to increase the polynuclear aromatic compound and cyanide binding sites. Alternately, the pre-treating step may occur before the PUF filter is shaped into the cylindrical body. The cylindrical body is incorporated into a cigarette as a filter such that when the cigarette is lit, smoke will pass through the PUF filter prior to being inhaled by a smoker.

DETAILED DESCRIPTION OF THE PREFERRED EMBODIMENT

Figure 1:
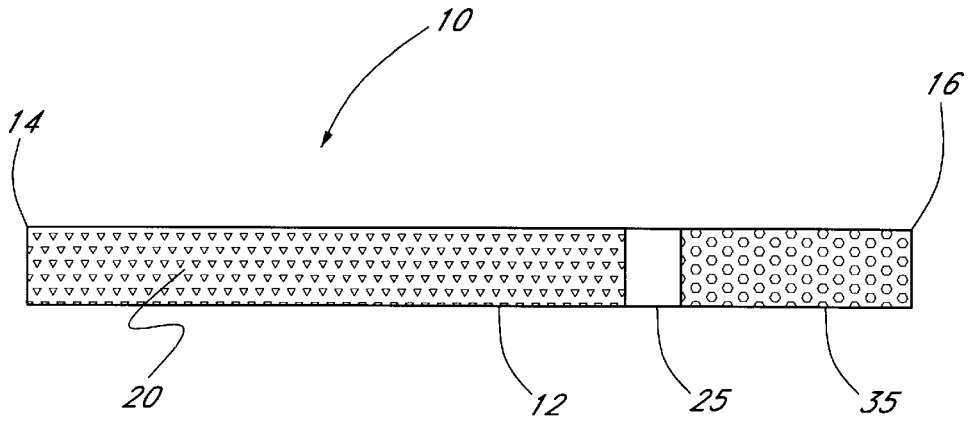
FIG. 1 is a cross-sectional view of a cigarette incorporating the filter of the present invention into the body of the cigarette.

Referring to FIG. 1, there is shown a cigarette 10 incorporating filter 35 of the present invention. Although illustrated and described in the context of a tobacco cigarette, it should be understood by those of skill in the art that the present invention may be readily applied to other tobacco products. For example, a larger diameter filter can be constructed in accordance with the principles described herein for use with cigars. Similarly, the filter of the present invention can be incorporated into or used with pipes and other apparatus used to smoke tobacco. Moreover, although the filter of the present invention is described as having a tubular or cylindrical shape, it should be appreciated by those of skill in the art that the filters of the present invention may take other shapes, including square, rectangular, spherical, and the like. In these other embodiments, the filter of the present invention will provide the same benefits described herein for cigarettes when the filter is placed in an environment where the tobacco smoke passes through the filter prior to being inhaled by the smoker.

As shown in FIG. 1, cigarette 10 comprises a cylindrical body 12 formed from a paper product which is wrapped around tobacco 20. Cigarette 10 has a distal end 14 and a proximal end 16. In this respect, cigarette 10 may be any conventional cigarette known to those of skill in the art, such as those made and sold today by the tobacco industry. Cigarette 10 may also incorporate a filter 25 near the proximal end 16 thereof. Filter 25 is also of the type conventionally used in cigarettes sold today, such as cellulose-based filters, but may be reduced in size when used in conjunction with polyurethane foam filters 35 of the present invention, as described below.

Polyurethane foam (PUF) has been used by United States Environmental Protection Agency to trap polynuclear aromatics, polychlorinated biphenyls, dioxins/furans, and the like, from air with reasonably high efficiency. These compounds have an affinity for polyurethane, and tend to be absorbed onto the surface of polyurethane. However, polyurethane foams generally do not efficiently absorb low molecular weight organic compounds, including compounds with a single aromatic ring. Thus, nicotine, which is a substituted pyridine, is not absorbed well by polyurethane foams. Furthermore, many of the compounds in tobacco smoke which contribute to the smoke's flavor are generally small volatile molecules that tend to not be absorbed by polyurethane foam.

In one embodiment, the benefits of the present invention are achieved by incorporating a filter 35 formed from a polyurethane foam into the body 12 of a tobacco product such as a cigarette 10. As shown in FIG. 1, the filter 35 is incorporated at proximal end 16 by being wrapped with a paper product. Preferably, cigarette 10 also incorporates a portion of conventional filter 25, and PUF filter 35 is positioned proximal to filter 25 at proximal end 16. When this two-filter combination is used, filter 25 will function to protect PUF filter 35 from burning when the tobacco is completely combusted. In this respect, it is preferred that filter 25 have a diameter approximately that of the cigarette body 12, and a length of from about 1 mm to about 4 mm, and more preferably from about 2 mm to about 3 mm.

As stated above, conventional filter 25 may be made of cellulose-based materials. However, other types of materials known to those of skill in the art may be used in place of filter 25 to protect filter 35, provided that the materials are compatible with polyurethane foam. Moreover, in some embodiments, it may be desirable to eliminate a protective filter 25, and use only the PUF filter 35 at the proximal end 16 of cigarette 10.

PUF filter 35 is formed from a polyurethane foam which has extensive cellular structure. Preferably, the foam is selected from middle-density polyurethane foams, which generally have a density of from about 0.01 to about 0.05 grams per milliliter. More preferably, the polyurethane foam used will have a density of from about 0.02 to about 0.04 grams per milliliter. However, it should be understood by those of skill in the art that any polyurethane foam with a cellular structure and appropriate density that permits cigarette smoke to pass through may be used with the present invention, provided that it conforms to the teachings herein. One foam found suitable for use in the present invention may be purchased from San Antonio Foam Fabricator, Product No. NA-85. This foam has a cellular structure and a density of 0.0302 grams per milliliter.

Filter 35 may vary in size and dimension as desired by the cigarette manufacturer. Preferably, filter 35 has approximately the same diameter as the cigarette in which it is incorporated and a length similar to conventional filters used today for cigarettes. This length may average from about 1 to 2.5 centimeters. Furthermore, because the beneficial effects of the present invention result from the polyurethane foam absorbing the harmful compounds, providing a larger polyurethane foam filter will tend to increase the total percentage of these compounds absorbed. As described in more detail below, a 2 cubic centimeter volume polyurethane foam formed into a filter has been shown to successfully absorb about 75% of the polynuclear aromatic compounds passing through it.

To maximize the toxic chemical and carcinogen removing benefits of the present invention, it is preferred that the polyurethane foam first be treated to increase the number of absorption sites for binding polynuclear aromatic compounds and toxic compounds. One method which has been shown useful to achieve this is Soxhlet extraction, which cleans the polyurethane foam and therefore increases the number of absorption sites. In this process, a solvent containing 6% ether in hexane is evaporated from a solvent reservoir. The solvent vapor is then condensed into a chamber containing the polyurethane foam to be treated. The polyurethane foam in the chamber is gradually immersed in the condensed solvent until it is totally immersed. Most of the contaminants on or in the polyurethane foam will be extracted into the solvent. The solvent in the chamber is then siphoned through a tube down to the solvent reservoir at the bottom. The solvent evaporated out of the solvent reservoir is always pure and free from contaminants from the polyurethane foam. Therefore, only contaminant-free solvent is condensed into the chamber and all contaminants from the polyurethane foam accumulate in the solvent reservoir. The solvent in the chamber is siphoned approximately once every hour for 16 hours. After the Soxhlet extraction, excess solvent is removed from the polyurethane foam by blowing it to dryness in nitrogen.

Other methods suitable to pre-treat the polyurethane foam and therefore increase its polynuclear aromatic compound and toxic compound binding sites may include extraction using solvents other than 6% ether in hexane, such as methylene chloride, hexane, light hydrocarbon based solvents, and mixtures of the foregoing. Furthermore, supercritical fluid extraction, steam distillation, hot solvent extraction and any other suitable organic extraction technique may also be used.

Figure 2:
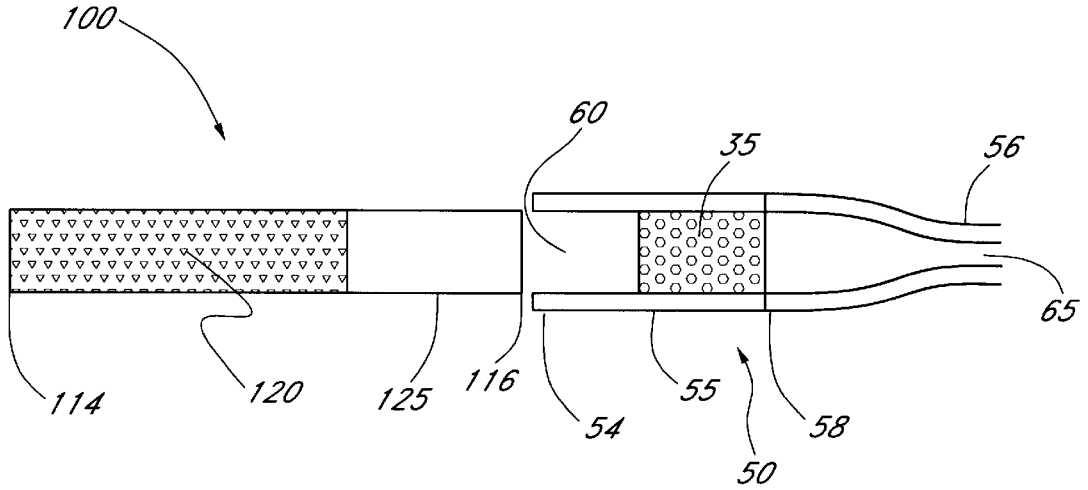
FIG. 2 is a cross-sectional view of a filter of the present invention incorporated into a cigarette holder which may be attached and detached from cigarettes.

Referring to FIG. 2, there is shown an alternative embodiment of the polyurethane foam filter of the present invention, where the filter is incorporated into a cigarette holder 50 which can be removably attached to a conventional cigarette 100. As shown in FIG. 2, cigarette 100 comprises a tubular body composed of a paper product wrapped around tobacco 120. A conventional filter 125 may be incorporated into the tubular body at proximal end 116, but this is not required. Cigarette holder 50 has a generally tubular body 55 which extends from distal end 54 to proximal end 56, and as shown in FIG. 2, tapers to a smaller diameter beginning at point 58 to form smaller diameter mouthpiece opening 65 at proximal end 56. Cigarette holder 50 may take a variety of other forms, as may be aesthetically pleasing or to provide ergonomic benefits. Furthermore, holder 50 may be formed from any of the variety of materials known to those of skill in the art to be useful for manufacture of cigarette holders, such as metals and plastics. Holder 50 may also vary in length, diameter and appearance, as desired by its manufacturer to provide for desired aesthetic and ergonomic properties.

For purposes of the present invention, holder 50 merely provides structure to encompass a polyurethane foam filter and provide an airway channel so that cigarette smoke inhaled by a smoker must pass through the polyurethane foam filter. For holder 50, such an airway channel is defined by lumen 60, which extends from the proximal end 56 to distal end 54.

Lumen 60 has a larger inner diameter at distal end 54, and is proportioned to receive the proximal end of a conventional cigarette. Preferably, lumen 60 is dimensioned to snugly fit over a conventional cigarette, such that a cigarette inserted into lumen 60 will be held firmly in place, but may be removed with minimal effort by a person. Incorporated into lumen 60 is a polyurethane foam (PUF) filter 35 of the present invention. Preferably, the PUF filter 35 has been pre-treated to increase the number of polynuclear aromatic compound and cyanide absorption or binding sites, as described above. Filter 35 should have a diameter to fill the entirety of lumen 60, such that any cigarette smoke which passes through lumen 60 to mouthpiece opening 65 must pass through PUF filter 35. This may be accomplished by forming filter 35 to have an uncompressed diameter slightly greater than that of lumen 60, and then slightly compressing filter 35 so that it fits snugly in lumen 60.

In this manner, polynuclear aromatic compounds and cyanide which contact and bind to the absorption sites in PUF filter 35 will be removed from cigarette smoke as they pass through filter 35. Because these compounds are removed from the smoke prior to being inhaled by a smoker, they should not adversely affect the smoker's health, and should not adversely affect bystander's health through second-hand smoke. However, as described previously, most of the nicotine present in the smoke will pass through the PUF filter 35 to mouthpiece opening 65.

The selective absorption properties of the polyurethane foam filters of the present invention are demonstrated in the following experimental examples.

EXPERIMENTAL EXAMPLES

A set of cylindrical PUF filters were cut from a sheet of NA-85 polyurethane foam. Each cylindrical PUF filter had an outside diameter (O.D.) of about 1 cm and a height of 1 inch (2.54 cm), and therefore in an uncompressed state had a volume of about 2 cubic centimeters. The PUF filters were then pre-treated to increase polynuclear aromatic and cyanide binding sites by Soxhlet extraction as described above with 6% ether in hexane for 16 hours. The PUF filters were then blown to dryness using nitrogen until all of the solvent was removed.

One of the PUF filters was slightly compressed and then inserted into clean 6.7 inch long and 0.8 cm inside diameter (I.D.) glass tubing with 1.8 cm tapered end. The filter end of a Dorall Full Flavor Premium cigarette was inserted into the other end of the glass tubing. Because the O.D. of PUF filter was slightly larger than the I.D. of the glass tubing, the PUF filter fit snugly in the tubing and all tobacco smoke passing through the glass tubing passed through the PUF filter. Teflon tape was wrapped around the filter end of the cigarette and glass tubing to seal them together. All of the Dorall cigarettes used in the study were from the same package.

The glass tubing was then connected horizontally to an inlet of a 100 mL impinger manufactured by Ace Glassware. The impinger used in this study was designed to trap polynuclear aromatics, cyanide and tar passing through the PUF filter. All the trapped polynuclear aromatics, cyanide and tar in the impinger would have been inhaled by a smoker if the cigarette had been smoked. The outlet of the impinger was connected to a hand-pump (Mityvac #OB61, Neward Enterprises, Cucamonga, Ca. Each press of the hand-pump pumped approximately 30–40 mL of air through the cigarette to simulate an inhalation by an average smoker. The impinger was then immersed in liquid argon and the cigarette was lit. Continuous pumping was then applied to the hand pump to suck the air through the cigarette. Cigarette smoke went through the PUF filter, impinger, and hand-pump before venting into a fume hood. The hand-pump was continuously pumped by hand until the cigarette had 4 mm of length left. The approximate sampling time was one minute.

After sampling, the impinger was filled with 70 mL of methylene chloride to dissolve the tar collected and left overnight. Afterwards, the methylene chloride was poured into a vial. The impinger was then rinsed with methylene chloride to capture any tar remaining in the impinger, and the rinse was poured into the same vial. The methylene chloride solution was concentrated down to 20 mL prior to gas chromatography and mass spectroscopy (GC/MS) analysis. A 4 mL sample of the methylene chloride solution was blown down with nitrogen to remove all methylene chloride and the residue or tar was weighed to five decimal places. The tar was weighed twice: one at five minutes after the first weighing and the second in the next day. The average of the tar weights is reported in Table 2.

The PUF filter used in the experiment was removed from the glass tubing. The PUF filter was then Soxhlet extracted using methylene chloride and the extract was concentrated to 5 mL before GC/MS analysis. One milliliter of the extract was used to measure the weight of tar by the method mentioned above.

This experiment was repeated as described above, except that in the second experiment the cigarette was completely burned. The conventional cigarette filter burned slightly before end of the sampling.

The same procedure as the first experiment was performed four more times with the following changes to the protocol:

- Experiment 3 was with a conventional filtered cigarette and without a PUF filter,
- Experiment 4 was with a partially filtered cigarette and a PUF filter,
- Experiment 5 was with an unfiltered cigarette and without a PUF filter,
- Experiment 6 was with a PUF filter, but without a cigarette (laboratory blank).

In Experiment 4, 75% of the regular cigarette filter was removed and replaced with a PUF filter without tearing the paper holding the cigarette filter. The remaining 25% of the regular cigarette filter segregated the cigarette from PUF filter to prevent burning of the PUF filter during this experiment.

Results

No compounds were detected in the laboratory blank in either the impinger and PUF filter (Experiment 6).

Table 1 compares the polynuclear aromatics and tar trapped in the impinger while (1) using the cigarette with only a conventional cigarette filter; (2) using a partially filtered cigarette with only a PUF filter; and (3) using the cigarette without any filter. As shown in Table 1, the PUF filter of the present invention is significantly better than regular cigarette filters in removing toxic polynuclear aromatics such as 2-methylnaphthalene, acenaphthylene, acenaphthene, dibenzofuran, fluorene, phenanthrene, anthracene, carbazole, fluoranthene, pyrene, benzo(a) anthracene and chrysene. This is demonstrated from comparing the weight of polynuclear aromatic compounds found in the impinger when a conventional filter was used to those found when the PUF filter was used. However, the nicotine and cotinine (oxidation product of nicotine) emissions from the cigarette with PUF filter are roughly the same as a cigarette with the regular cigarette filter.

The percentage of polynuclear aromatics and tar removed in the other experiments using the PUF filter are listed in Table 2 to 4 and summarized in Table 5. In those experiments where a 2 cubic centimeter PUF filter is used in conjunction with a regular cigarette filter, the PUF filter of the present invention removed about 60% of polynuclear aromatic compounds in cigarette smoke which contacted it, or 30% per cubic centimeter of uncompressed foam material. Furthermore, the PUF filter permitted about 75% of the nicotine in cigarette smoke which contacted the PUF filter to pass through. In those embodiments in which about 75% of the regular filter of a cigarette was replaced with the PUF filter, the PUF filter removed about 74% of polynuclear aromatic compounds contacting it, or about 37% per cubic centimeter of uncompressed foam material, but still permitted about 75% of the nicotine in cigarette smoke to pass through.

As noted above, a PUF cylindrical body having a volume of 2 cubic centimeters in its uncompressed state was slightly compressed and inserted into the experimental apparatus to function as a filter. In Experiment 4, this PUF filter removed 74% of the polynuclear aromatic compounds when used without a complete regular filter (75% of the regular filter removed), compared to only 60% when a complete regular filter was used as in Experiment 1. This may be due to the fact that there are significant amounts of glycerol triacetate embedded in most regular cigarette filters. It was observed that the amount of glycerol triacetate found in each experiment was approximately the same as that of nicotine. The glycerol triacetate emitted during these experiments may be trapped by the PUF filters. The trapped glycerol triacetate would occupy many of the absorption sites on the PUF filter, which would be otherwise available for polynuclear aromatics. Therefore, with a complete regular cigarette filter, the efficacy of the PUF filter trapping polynuclear aromatics was reduced, compared to when used with only a partial (25%) regular cigarette filter. In view of these results, it is expected that the percentage of polynuclear aromatic compounds absorbed by the PUF filter would increase from 74% to about 80–90% per 2 cubic centimeters of uncompressed PUF starting material, if the PUF filter is used without any conventional cigarette filter, or if the amount of glycerol triacetate in regular cigarette filters is reduced.

Three more experiments were performed to determine the efficiency of PUF filters in removing cyanide from cigarette smoke. These experiments were performed in the same manner as the first experiment. However, instead of 70 mL of methylene chloride to dissolve tar trapped in the impinger by liquid argon, 37 mL of 0.25 N sodium hydroxide was added to impinger to rinse and convert trapped inorganic cyanide compounds to cyanide anion, which was then analyzed by ion chromatography. For a cigarette with conventional filter but without PUF filter, 660 micrograms of total cyanide were found in the 37 mL impinger rinsing solution. This was from the smoke that would have been inhaled by the smoker if the cigarette had been smoked. However, for a cigarette with both regular filter and PUF filter, 250 micrograms of total cyanide were found in the 37 mL impinger rinsing solution. For a blank, an unlit cigarette with regular filter but without PUF filter was used. For the blank, cyanide was not found at the detection limit of 3.7 micrograms in the 37 mL impinger rinsing solution. These experiments indicate that approximate 62% of total cyanide in cigarette smoke passing through the PUF filter was removed by a PUF filter of the present invention.

Because the PUF filters used in this study are made from medium density polyurethane foam, the pressure drop across the PUF filter is much lower than regular cigarette filter. Most smokers familiar with a conventional cigarette filter may not be familiar with a filter which has a low pressure drop. Consequently, they may inhale larger quantities of smoke at the beginning. Therefore, smokers may either be informed of the lower pressure drop, or use a PUF filter as an additional filter after the regular cigarette filter. In the latter way, the PUF filter may be inserted in a cigarette holder and then a cigarette with regular filter is inserted into the cigarette holder before smoking.

TABLE 1

Comparison of Polynuclear Aromatic Emissions (in ng) of Cigarette Smoke from a Filterless Cigarette, a Conventional Cigarette with a Filter, and a Cigarette With a PUF Filter

| Compound | Cigarette Filter: NONE PUF Filter: NONE (Experiment 5) | Cigarette Filter: YES PUF Filter: NO (Experiment 3) | Cigarette Filter: PARTIAL PUF Filter: YES (Experiment 4) |
|---|---|---|---|
| 2-methyl-naphthalene | 4600 | 1872 | 625 |
| acenaphthylene | 714 | 647 | 45 |
| acenaphthene | 469 | 230 | 44 |
| dibenzofuran | 451 | 106 | 37 |
| fluorene | 1126 | 40 | 159 |
| phenanthrene | 736 | 274 | 74 |
| anthracene | 298 | 95 | 26 |
| carbazole | 984 | 513 | 153 |
| fluoranthene | 198 | 96 | 29 |
| pyrene | 213 | 124 | 29 |
| benzo(a)an-thracene | 212 | 139 | 43 |
| chrysene | 99 | 35 | 7 |
| Tar | 14600000 | 7370000 | 6830000 |
| Nicotine | 2500000 | 1340000 | 1550000 |
| Cotinine | 18400 | 11900 | 10200 |

TABLE 2

Analytical Results of Experiment 1
Cigarette Filter: YES, PUF Filter YES

| Compound | Amount Trapped by PUF Filter in ng | Amount Collected in Impinger After PUF Filter in ng | Percentage of Total Amount Absorbed by PUF Filter |
|---|---|---|---|
| 2-methylnaphthalene | 1610 | 618 | 72% |
| acenaphthylene | 215 | 144 | 60% |
| acenaphthene | 168 | 89 | 65% |
| dibenzofuran | 116 | 39 | 75% |
| fluorene | 236 | 111 | 68% |
| phenanthrene | 138 | 94 | 59% |
| anthracene | 42 | 47 | 47% |
| carbazole | 80 | 248 | 24% |
| fluoranthene | 26 | 71 | 27% |
| pyrene | 21 | 68 | 24% |
| benzo(a)anthracene | | 122 | 0% |
| chrysene | | | |
| Total Polynuclear Aromatics[1] | 2652 | 1651 | 62% |
| Tar | 340000 | 2990000 | 10% |
| Nicotine | 263000 | 759000 | 26% |
| Cotinine | 17 | 5328 | 0% |

[1]As used herein and in the claims, the phrase "Total Polynuclear Aromatics" refers to the summation of the concentrations of all polynuclear aromatics (from 2-methyInaphtha1ene to chrysene) listed in this table.

TABLE 3

Analytical Results of Experiment 2
Cigarette Filter YES, PUF Filter: YES,
Cigarette: Burned Completely and
Cigarette Filter Slightly Burned

| Compound | Amount Trapped by PUF Filter in ng | Amount Collected in Impinger After PUF Filter in ng | Percentage of Total Amount Absorbed by PUF Filter |
|---|---|---|---|
| 2-methylnaphthalene | 1862 | 867 | 68% |
| acenaphthylene | 345 | 215 | 62% |
| acenaphthene | 211 | 89 | 70% |
| dibenzofuran | 123 | 37 | 77% |
| fluorene | 362 | 201 | 64% |
| phenanthrene | 151 | 82 | 65% |
| anthracene | 50 | 193 | 21% |
| carbazole | 110 | 306 | 26% |
| fluoranthene | 31 | 87 | 26% |
| pyrene | 32 | 108 | 23% |
| benzo(a)anthracene | 39 | 135 | 22% |
| chrysene | | | |
| Total Polynuclear Aromatics[1] | 3316 | 2320 | 59% |
| Tar | 800000 | 4920000 | 14% |
| Nicotine | 372000 | 1220000 | 23% |
| Cotinine | 1390 | 8000 | 15% |

TABLE 4

Analytical Results of Experiment 4
Cigarette Filter: PARTIAL, PUF Filter YES

| Compound | Amount Trapped by PUF Filter in ng | Amount Collected in Impinger After PUF Filter in ng | Percentage of Total Amount Absorbed by PUF Filter |
|---|---|---|---|
| 2-methylnaphthalene | 1782 | 625 | 74% |
| acenaphthylene | 30 | 45 | 40% |
| acenaphthene | 261 | 44 | 86% |
| dibenzofuran | 257 | 37 | 87% |
| fluorene | 642 | 159 | 80% |
| phenanthrene | 268 | 74 | 78% |
| anthracene | 101 | 26 | 80% |
| carbazole | 173 | 153 | 53% |
| fluoranthene | 43 | 29 | 60% |
| pyrene | 39 | 29 | 57% |
| benzo(a)anthracene | 42 | 43 | 49% |
| chrysene | 11 | 7 | 61% |
| Total Polynuclear Aromatics[1] | 3649 | 1271 | 74% |
| Tar | 1540000 | 6830000 | 18% |
| Nicotine | 514000 | 1550000 | 25% |
| Cotinine | 2080 | 10200 | 17% |

TABLE 4

Summary of Percentage of Total Polynuclear Aromatics Absorbed by PUF Filter

| Compound | Experiment 1 Cigarette Filter: YES PUF Filter: YES | Experiment 2 Cigarette Filter: YES PUF Filter: YES Cigarette Completely Burned and Cigarette Filter Slightly Burned | Experiment 4 Cigarette Filter: PARTIAL PUF Filter: YES | Average of Percentage of Total Amount Absorbed by PUF Filter: Average | Standard Deviation |
|---|---|---|---|---|---|
| 2-methylnaphthalene | 72% | 68% | 74% | 71% | 2% |
| acenaphthylene | 60% | 62% | 40% | 54% | 10% |
| acenaphthene | 65% | 70% | 86% | 74% | 9% |
| dibenzofuran | 75% | 77% | 87% | 80% | 5% |
| fluorene | 68% | 64% | 80% | 71% | 7% |
| phenanthrene | 59% | 65% | 78% | 67% | 8% |
| anthracene | 47% | 21% | 80% | 49% | 24% |
| carbazole | 24% | 26% | 53% | 34% | 13% |
| fluoranthene | 27% | 26% | 60% | 38% | 16% |
| pyrene | 24% | 23% | 57% | 35% | 16% |
| benzo(a)anthracene | 0% | 22% | 49% | 24% | 20% |
| chrysene | | | 61% | 61% | 0% |
| Total Polynuclear Aromatics[1] | 62% | 59% | 74% | 65% | 6% |
| Tar | 10% | 14% | 18% | 14% | 3% |
| Nicotine | 26% | 23% | 25% | 25% | 1% |
| Cotinine | 0% | 15% | 17% | 11% | 8% |

Although this invention has been described in terms of certain preferred embodiments, other embodiments will be apparent to those of ordinary skill in the art in view of the disclosure herein are also within the scope of this invention.

Accordingly, the scope of the invention is intended to be defined only by reference to the appended claims.

What is claimed is:

1. A filter for removing polynuclear aromatic compounds and cyanide from tobacco smoke, comprising:

a tubular body with a proximal and a distal end, the tubular body being formed out of middle-density cellular polyurethane foam which has been pre-treated to increase the number of absorption sites for polynuclear aromatic compounds and cyanide; and wherein the filter removes polynuclear aromatic compounds and cyanide by absorbing on its surface area at least 60% of the total polynuclear aromatic compounds and cyanide contained in tobacco smoke which pass through the filter, but permits about 75% of the nicotine in tobacco smoke to pass through.

2. The filter of claim 1, wherein the filter removes at least about 75% of the total polynuclear aromatic compounds in tobacco smoke which pass through the filter.

3. The filter of claim 2, wherein the filter removes at least about 90% of the total polynuclear aromatic compounds in tobacco smoke which pass through the filter.

4. The filter of claim 1, wherein the form has a density of between about 0.01 g/ml to about 0.05 g/ml.

5. The filter of claim 4, wherein the polyurethane foam has a density of betwee 0.02 g/ml to about 0.04 g/ml.

6. The filter of claim 1, wherein the pre-treatment consists of extraction of impurities from the absorption sites using a solvent.

7. The filter of claim 1, incorporated into a cigarette holder.

8. The filter of claim 1, incorporated into the body of a cigarette.

9. The filter of claim 1, wherein the polyurethane filter is used in conjunction with a regular cigarette filter.

10. An improved filter for removing carcinogenic compounds and cyanide from tobacco smoke, comprising a pre-treated polyurethane foam body with increased absorption sites for polynuclear aromatic compounds and cyanide wherein the filter removes carcinogenic compounds and cyanide by absorbing on its surface area 30–45% of total polynuclear aromatic compounds passing through the filter per cubic centimeter of uncompressed polyurethane foam material, but which permits more than 30% of the contacting nicotine to pass through unabsorbed per cubic centimeter of polyurethane foam material.

11. The filter of claim 10, wherein the pre-treatment increases the number of polynuclear aromatic compound and cyanide binding sites in comparison to untreated polyurethane foam of similar density and cellular structure.

12. The filter of claim 11, wherein the filter is incorporated into a cigarette body.

13. The filter of claim 11, wherein the filter is incorporated into a cigar.

14. The filter of claim 11, wherein the filter is incorporated into a pipe.

15. A pre-treated polyurethane foam filter which absorbs in aggregate more than 60% of 2-methylnaphthalene, acenaphthylene, acenaphthene, dibenzofuran, fluorene, phenanthrene, anthracene, carbazole, fluoranthene, pyrene, benzo(a)anthracene, chrysene in tobacco smoke passing through the filter per 2 cubic centimeters of uncompressed foam material used to make the filter.

* * * * *